US007412847B2

(12) United States Patent
Huang

(10) Patent No.: US 7,412,847 B2
(45) Date of Patent: Aug. 19, 2008

(54) METAL DECORATIVE ARTICLE

(76) Inventor: Ya-Tsai Huang, No. 19, Pu-Hsi St., Changhua City, Changhua Hsien (TW)

( * ) Notice: Subject to any disclaimer, the term of this patent is extended or adjusted under 35 U.S.C. 154(b) by 215 days.

(21) Appl. No.: 11/503,880

(22) Filed: Aug. 14, 2006

(65) Prior Publication Data

US 2008/0034629 A1 Feb. 14, 2008

(51) Int. Cl.
*A44C 15/00* (2006.01)

(52) U.S. Cl. ..... 63/18; 63/23; 40/729; 40/798

(58) Field of Classification Search ..... None
See application file for complete search history.

(56) References Cited

U.S. PATENT DOCUMENTS 1,422,819 A * 7/1922 Blaicher ..... 63/15
1,683,545 A * 9/1928 Harris ..... 63/1.15
D230,762 S * 3/1974 Patterson ..... D11/80
6,557,375 B1 * 5/2003 Simmons et al. ..... 63/1.15

* cited by examiner

*Primary Examiner*—Jack W. Lavinder
(74) *Attorney, Agent, or Firm*—Trop, Pruner & Hu, P.C.

(57) ABSTRACT

A metal decorative article includes: a first decorative member formed with a first hole pattern of through-holes, the first hole pattern having inner and outer sides, each of the through-holes extending from the outer side to the inner side, and having an outer peripheral edge on the outer side and an inner peripheral edge on the inner side, the outer peripheral edge of each of the through-holes having dimensions different from those of the inner peripheral edge of the respective one of the through-holes; a second decorative member formed with a second hole pattern of through-holes having inner and outer sides that are respectively symmetrical to the inner and outer sides of the first hole pattern; and a frame defining a frame space. The first and second decorative members are respectively received in the frame space of the frame such that the inner sides face each other and are spaced apart from each other by a gap.

8 Claims, 8 Drawing Sheets

METAL DECORATIVE ARTICLE

BACKGROUND OF THE INVENTION

1. Field of the Invention

This invention relates to a metal decorative article, more particularly to a metal decorative article that is lightweight and that has an improved appearance.

2. Description of the Related Art

FIGS. 1 to 3 illustrate a conventional metal decorative article 1 formed with a hole pattern 11 of through-holes 113 having front and back sides 111, 112. Each of the through-holes 113 extends from the front side 111 to the back side 112 and has a first peripheral edge 114 on the front side 111 and a second peripheral edge 115 on the back side 112. During manufacture, to facilitate removal of the article 1 from a mold, one of the first peripheral edge 114 and the second peripheral edge 115 is designed to have a size larger than that of the other one. However, such design causes undesired and unattractive hole pattern 11 on one of the front and back sides 111, 112 of the metal decorative article 1. In particular, as shown in FIG. 2, while the appearance of the hole pattern 11 on the front side 111 of the metal decorative article 1 is desired, the size of each of the through-holes 113 on the rear side 112 is larger than that of the respective one on the front side 111, so that the second peripheral edge 115 of each of the holes 113 overlaps those of the adjacent ones (see FIG. 3), thereby resulting in an unattractive hole pattern 11 on the back side 112 of the metal decorative article 1. In another situation, while the size of the second peripheral edge 115 on the rear side 112 is to be designed to be smaller than the first peripheral edge 114 on the front side 111, the desired appearance of the hole pattern 11 on the rear side 112 cannot be achieved (i.e., smaller than the desired pattern). In addition, since the article 1 has a relatively large thickness, it is relatively heavy and removal of the article 1 from a mold becomes difficult.

Therefore, there is a need in the art to provide a metal decorative article that is lightweight and that has a superior appearance on both sides.

SUMMARY OF THE INVENTION

Therefore, the object of the present invention is to provide a metal decorative article that can overcome the aforesaid drawbacks of the prior art.

According to one aspect of this invention, a metal decorative article comprises: a first decorative member formed with a first hole pattern of through-holes, the first hole pattern having first inner and first outer sides, each of the through-holes extending from the first outer side to the first inner side, each of the through-holes in the first hole pattern having a first outer peripheral edge on the first outer side and a first inner peripheral edge on the first inner side, the first outer peripheral edge of each of the through-holes having dimensions different from those of the first inner peripheral edge of the respective one of the through-holes; a second decorative member formed with a second hole pattern of through-holes, the second hole pattern having second inner and second outer sides, each of the through-holes extending from the second outer side to the second inner side, each of the through-holes in the second hole pattern having a second outer peripheral edge on the second outer side and a second inner peripheral edge on the second inner side, the second outer peripheral edge of each of the through-holes having dimensions different from those of the second inner peripheral edge of the respective one of the through-holes; and a frame defining a frame space having first and second ends, the first decorative member and the second decorative member being respectively received in the first and second ends of the frame space in the frame such that the first inner side of the first hole pattern and the second inner side of the second hole pattern face each other and are spaced apart from each other by a gap.

According to another aspect of this invention, a metal decorative article comprises: a first decorative member formed with a first hole pattern of through-holes, the first hole pattern having inner and outer sides, each of the through-holes extending from the outer side to the inner side, each of the through-holes in the first hole pattern having an outer peripheral edge on the outer side and an inner peripheral edge on the inner side, the outer peripheral edge of each of the through-holes having dimensions different from those of the inner peripheral edge of the respective one of the through-holes; a second decorative member formed with a second hole pattern of through-holes, the second hole pattern having inner and outer sides respectively symmetrical to the inner and outer sides of the first hole pattern; and a frame defining a frame space having first and second ends, the first decorative member and the second decorative member being respectively received in the first and second ends of the frame space in the frame such that the inner side of the first hole pattern and the inner side of the second hole pattern face each other and are spaced apart from each other by a gap.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
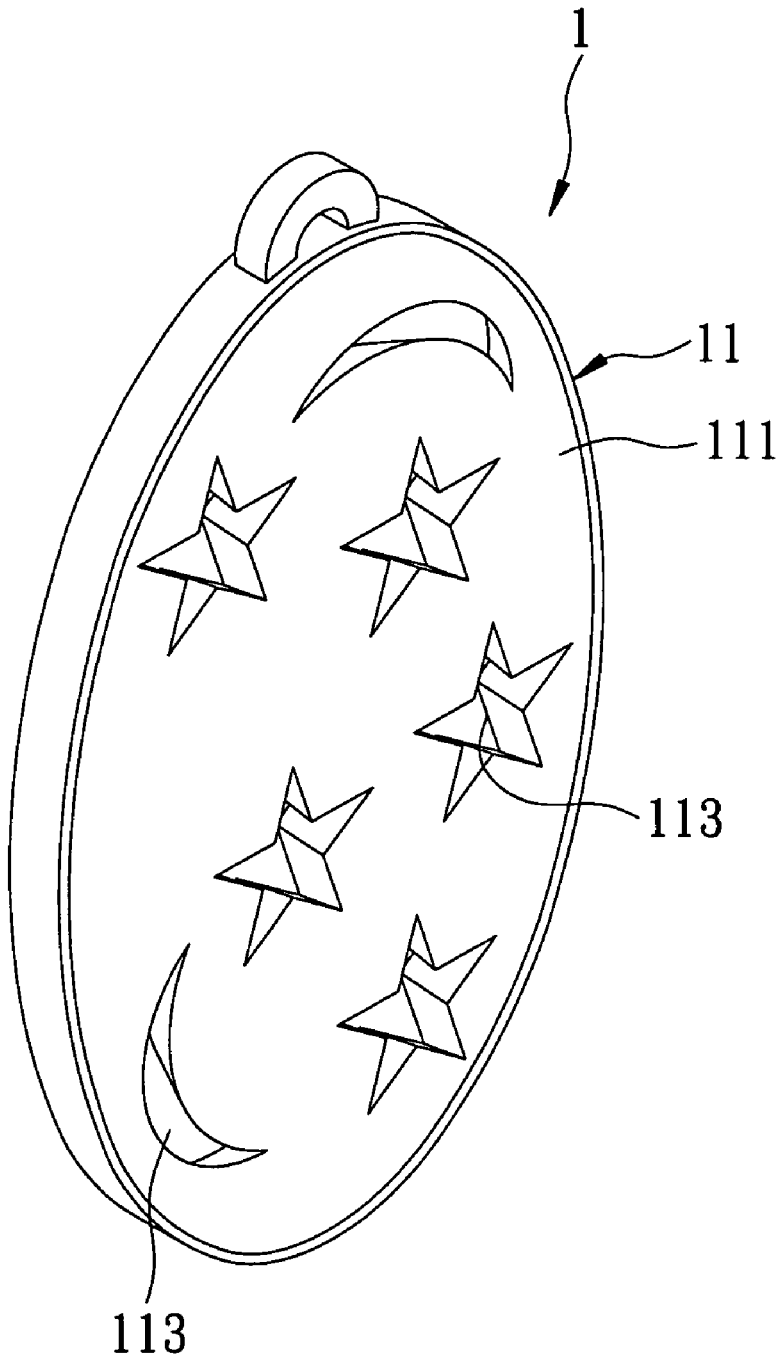
FIG. 1 PRIOR ART
FIG. 1 is a perspective view of a conventional metal decorative article.
Figure 3:
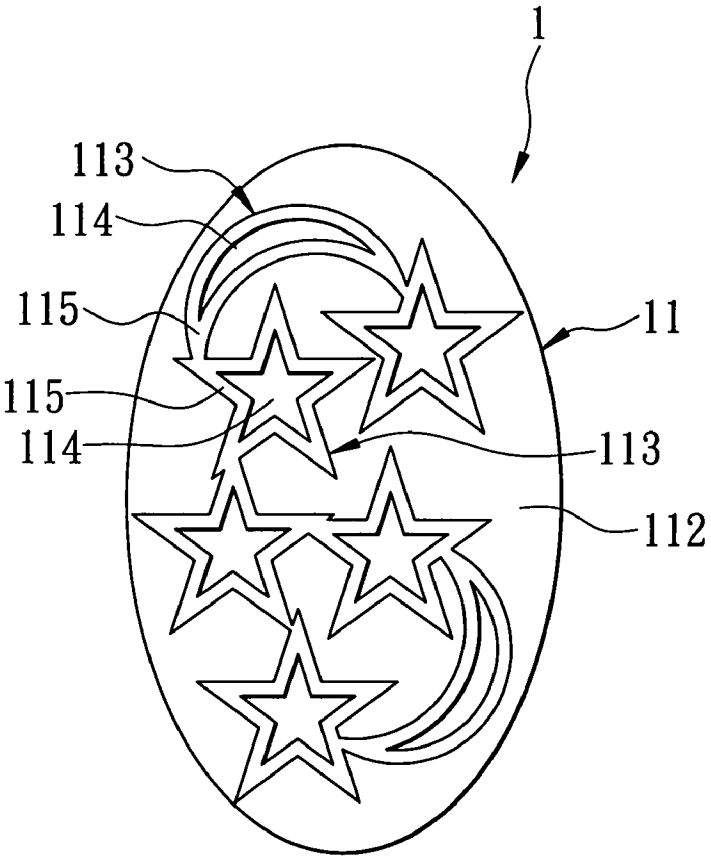
FIG. 3 PRIOR ART
FIG. 3 is a rear view of the conventional metal decorative article shown in FIG. 1.
Figure 2:
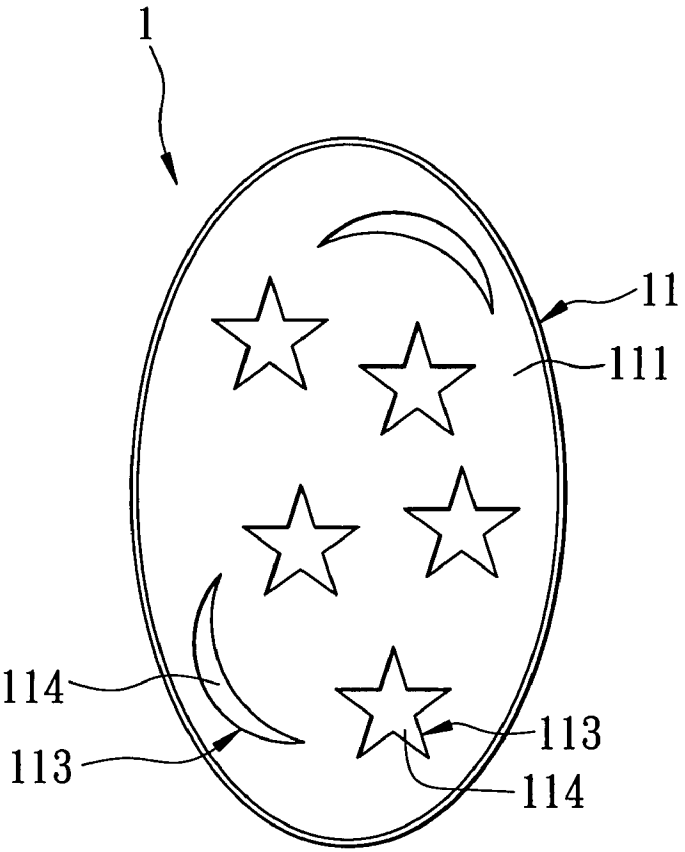
FIG. 2 PRIOR ART
FIG. 2 is a front view of the conventional metal decorative article shown in FIG. 1.
Figure 4:
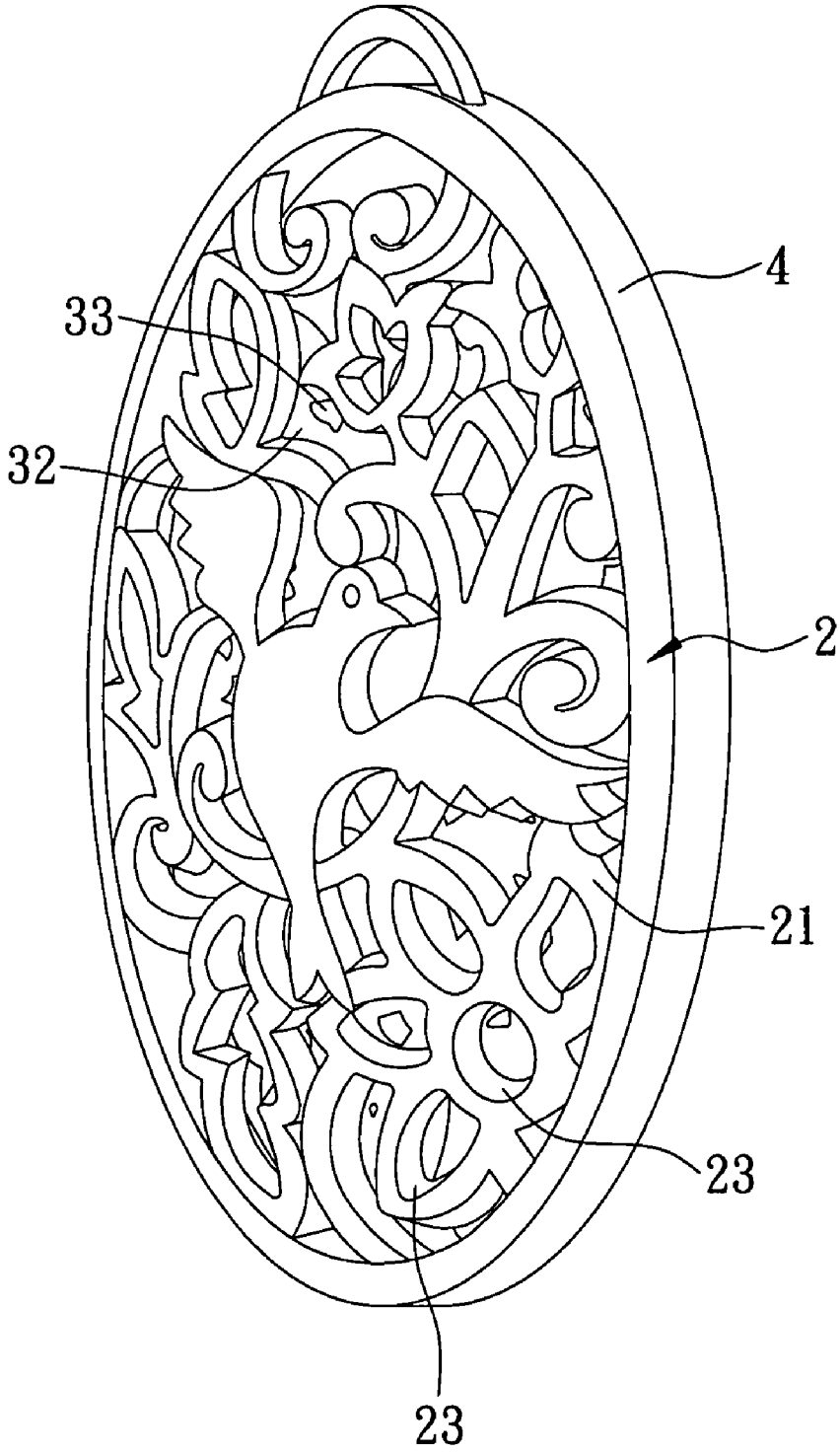
FIG. 4 is a perspective view of the first preferred embodiment of a metal decorative article according to this invention.
Figure 6:
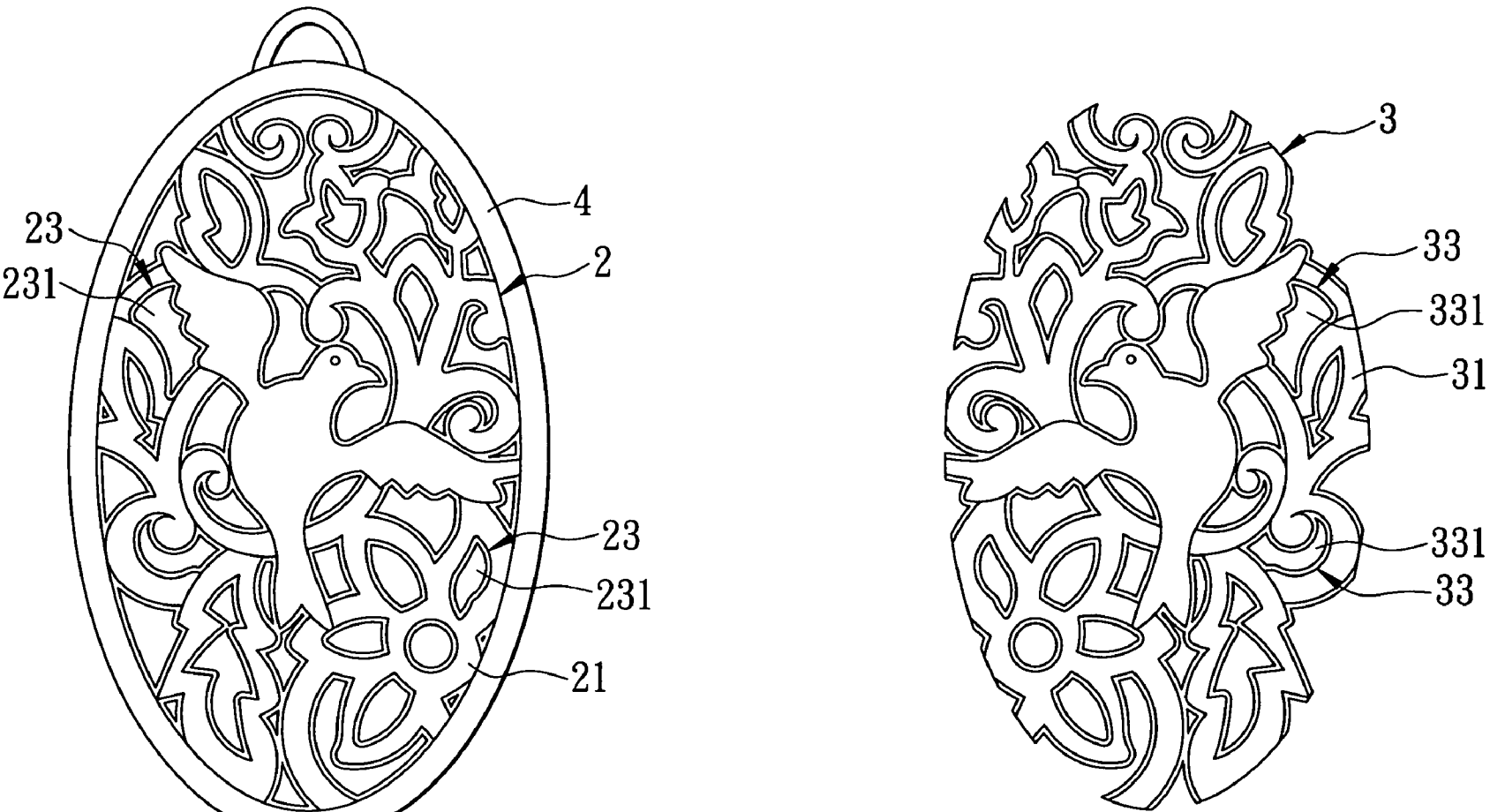
FIG. 6 shows outer sides of first and second hole patterns of first and second decorative members of the first preferred embodiment, which are symmetrical to each other.

Referring to FIGS. 4 and 6, the first preferred embodiment of a metal decorative article according to the present invention is shown to include a first decorative member 2 formed with a first hole pattern of through-holes 23; a second decorative member 3 formed with a second hole pattern of through-holes 33; and a frame 4 defining a frame space having first and second ends.

Figure 5:
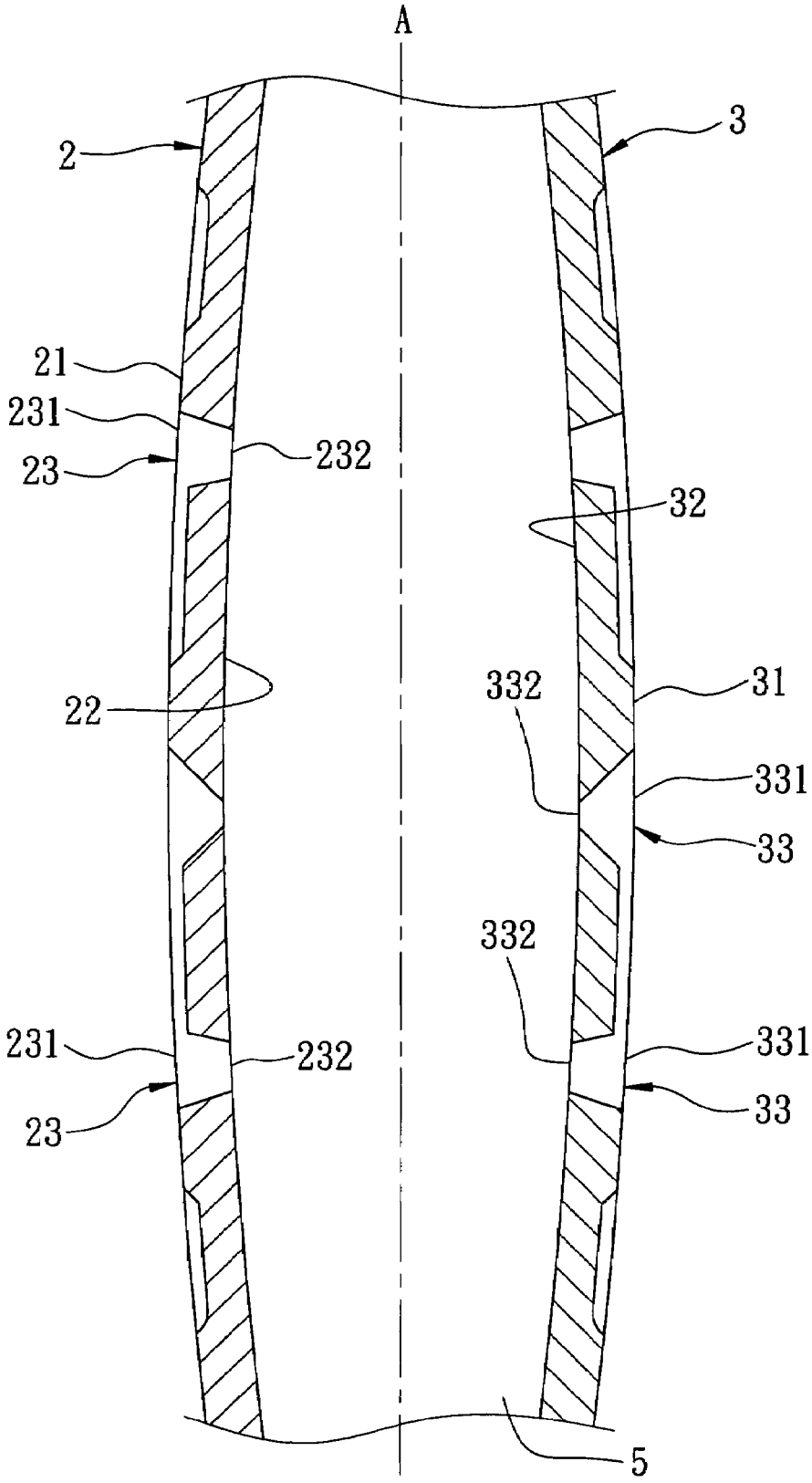
FIG. 5 is a fragmentary schematic cross-sectional view of the first preferred embodiment.

As shown in FIG. 5, the first hole pattern has inner and outer sides 22, 21. Each of the through-holes 23 in the first hole pattern extends from the outer side 21 to the inner side 22, and has an outer peripheral edge 231 on the outer side 21 and an inner peripheral edge 232 on the inner side 22. Similarly, the second hole pattern has inner and outer sides 32, 31. Each of the through-holes 33 in the second hole pattern extends from the outer side 31 to the inner side 32, and has an outer peripheral edge 331 on the outer side 31 and an inner peripheral edge 332 on the inner side 32. The first decorative member 2 and the second decorative member 3 are respectively received in the first and second ends of the frame space in the frame 4 such that the inner side 22 of the first hole pattern and the inner side 32 of the second hole pattern face each other and are spaced apart from each other by a gap 5.

The outer peripheral edge 231, 331 of each of the through-holes 23, 33 on the outer sides 21, 31 of the first and second hole patterns has dimensions (or a size) which can be larger or smaller than those of the inner peripheral edge 232, 332 of the respective one of the through-holes 23, 33 on the inner sides 22, 32 of the first and second hole patterns. In this embodiment, the outer peripheral edge 231 of each of the through-holes 23 has dimensions (or a size) larger than those of the inner peripheral edge 232 of the respective one of the through-holes 23. The desired size of the first hole pattern is on the outer side 21.

Figure 7:
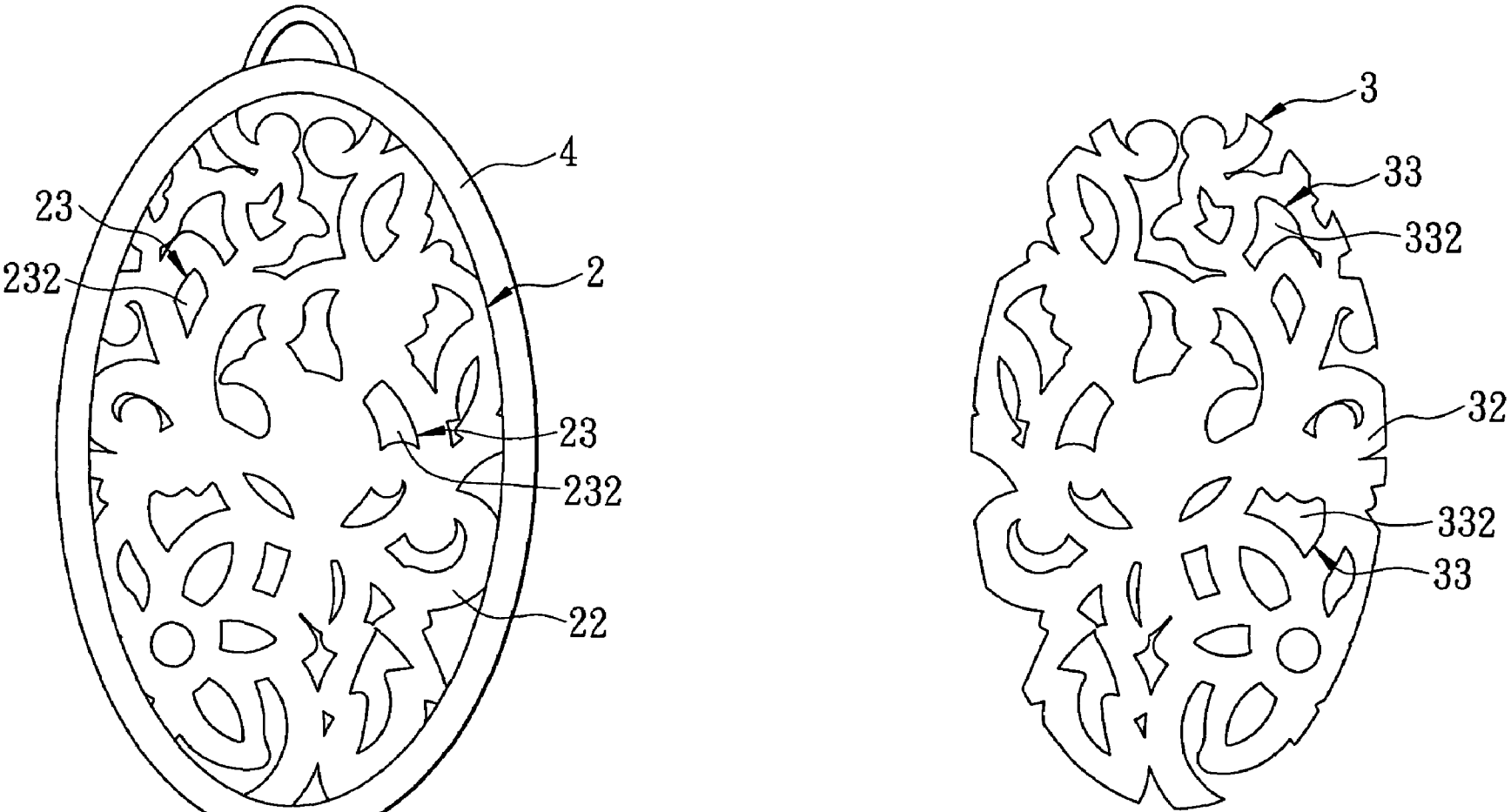
FIG. 7 shows inner sides of first and second hole patterns of first and second decorative members of the first preferred embodiment, which are symmetrical to each other.

Moreover, in this embodiment, the inner and outer sides 32, 31 of the second hole pattern respectively symmetrical to the inner and outer sides 22, 21 of the first hole pattern with respect to an imaginary plane (A) (see FIGS. 5 to 7). As such, the outer peripheral edge 331 of each of the through-holes 33 has dimensions (or a size) larger than those of the inner peripheral edge 332 of the respective one of the through-holes 33, and the desired size of the second hole pattern is shown on the outer side 31.

Therefore, the desired hole patterns appear on the outer sides 21, 31, thereby improving the appearance of the article. In addition, compared to a similarly sized conventional metal decorative article, since the metal decorative article of this invention is composed of two thinner decorative members 2, 3 (which are spaced apart from each other by the gap 5), the weight thereof is reduced.

Figure 8:
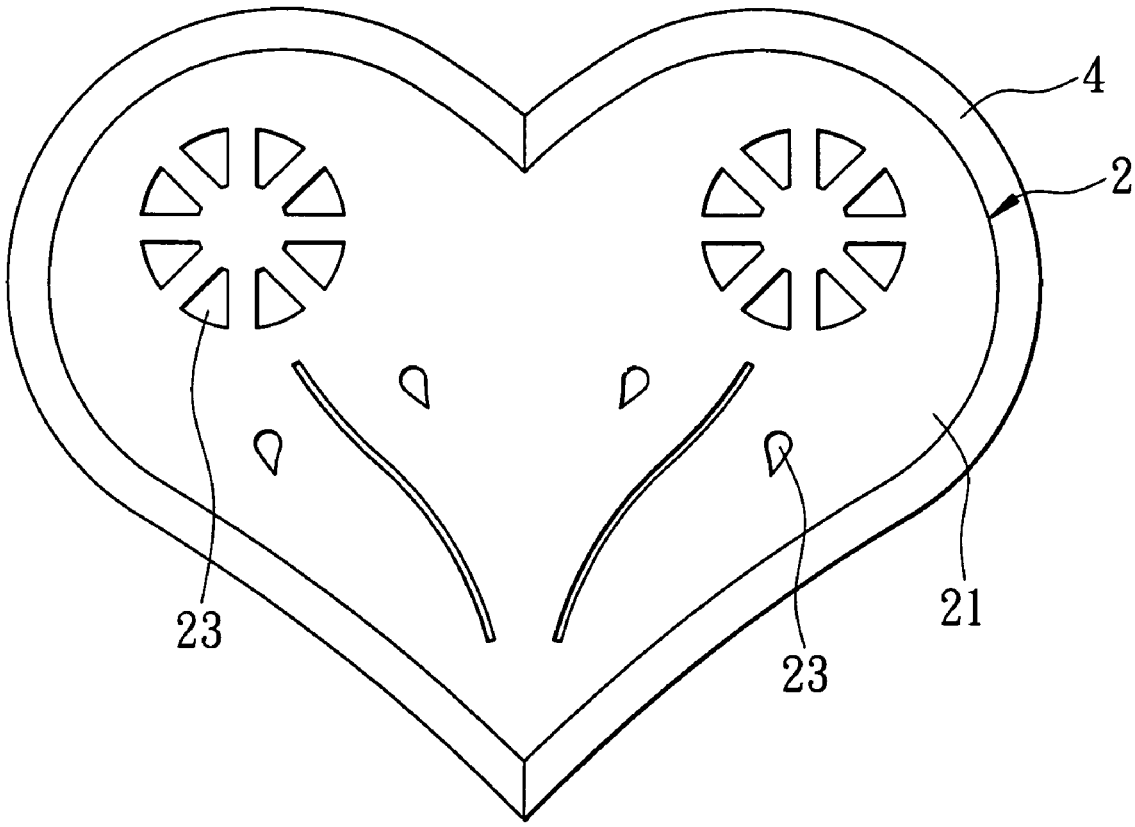
FIG. 8 shows a hole pattern of the second preferred embodiment of a metal decorative article according to this invention.
Figure 9:
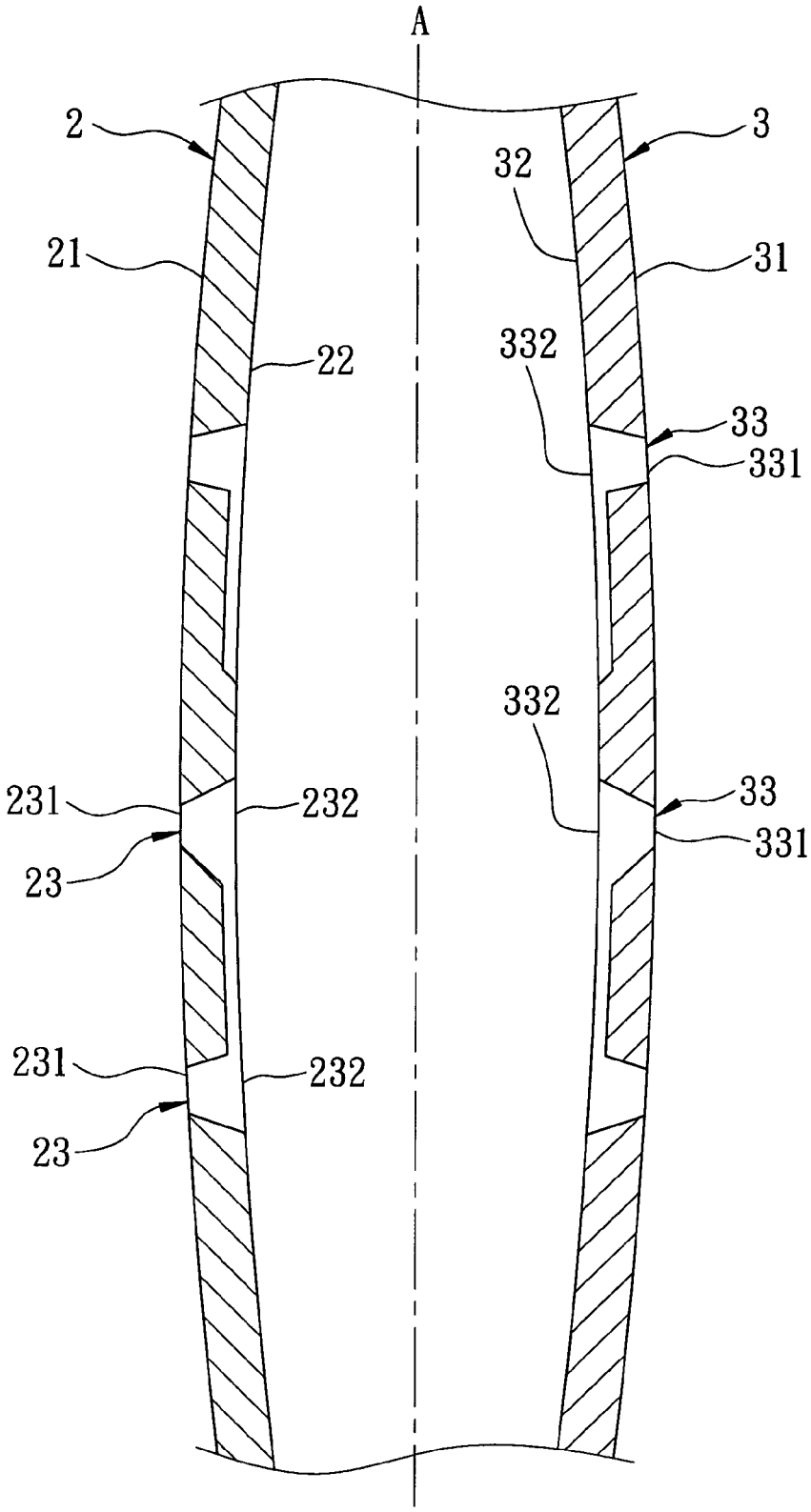
FIG. 9 is a fragmentary schematic cross-sectional view of the second preferred embodiment.

FIG. 8 illustrates a hole pattern of the second preferred embodiment of a metal decorative article according to this invention. In addition to the pattern design, this preferred embodiment differs from the previous embodiment in that the dimensions (or sizes) of the outer peripheral edges 231, 331 of an adjacent pair of the through-holes 23, 33 on the outer sides 21, 31 are smaller than those of the inner peripheral edges 232, 332 of the respective ones of the through-holes 23, 33 on the inner sides 22, 32, as best shown in FIG. 9.

In view of the design of the present invention, the metal decorative article can have the desired appearance on both outer sides and can be made lightweight while maintaining the advantage of easy removal from a mold.

While the present invention has been described in connection with what is considered the most practical and preferred embodiments, it is understood that this invention is not limited to the disclosed embodiments but is intended to cover various arrangements included within the spirit and scope of the broadest interpretation and equivalent arrangements.

What is claimed is:

1. A metal decorative article comprising:

a first decorative member formed with a first hole pattern of through-holes, said first hole pattern having first inner and first outer sides, each of said through-holes extending from said first outer side to said first inner side, each of said through-holes in said first hole pattern having a first outer peripheral edge on said first outer side and a first inner peripheral edge on said first inner side, said first outer peripheral edge of each of said through-holes having dimensions different from those of said first inner peripheral edge of the respective one of said through-holes;

a second decorative member formed with a second hole pattern of through-holes, said second hole pattern having second inner and second outer sides, each of said through-holes extending from said second outer side to said second inner side, each of said through-holes in said second hole pattern having a second outer peripheral edge on said second outer side and a second inner peripheral edge on said second inner side, said second outer peripheral edge of each of said through-holes having dimensions different from those of said second inner peripheral edge of the respective one of said through-holes; and a frame defining a frame space having first and second ends, said first decorative member and said second decorative member being respectively received in said first and second ends of said frame space in said frame such that said first inner side of said first hole pattern and said second inner side of said second hole pattern face each other and are spaced apart from each other by a gap.

2. The metal decorative article of claim 1, wherein the dimensions of said first outer peripheral edge of each of said through-holes on said first outer side of said first hole pattern are larger than those of said first inner peripheral edge of the respective one of said through-holes on said first inner side of said first hole pattern, and wherein the dimensions of said second outer peripheral edge of each of said through-holes on said second outer side of said second hole pattern are larger than those of said second inner peripheral edge of the respective one of said through-holes on said second inner side of said second hole pattern.

3. The metal decorative article of claim 1, wherein the dimensions of said first outer peripheral edge of each of said through-holes on said first outer side of said first hole pattern are larger than those of said first inner peripheral edge of the respective one of said through-holes on said first inner side of said first hole pattern, and wherein the dimensions of said second outer peripheral edge of each of said through-holes on said second outer side of said second hole pattern are smaller than those of said second inner peripheral edge of the respective one of said through-holes on said second inner side of said second hole pattern.

4. The metal decorative article of claim 1, wherein the dimensions of said first outer peripheral edge of each of said through-holes on said first outer side of said first hole pattern are smaller than those of said first inner peripheral edge of the respective one of said through-holes on said first inner side of said first hole pattern, and wherein the dimensions of said second outer peripheral edge of each of said through-holes on said second outer side of said second hole pattern are larger than those of said second inner peripheral edge of the respective one of said through-holes on said second inner side of said second hole pattern.

5. The metal decorative article of claim 1, wherein the dimensions of said first outer peripheral edge of each of said through-holes on said first outer side of said first hole pattern are smaller than those of said first inner peripheral edge of the respective one of said through-holes on said first inner side of said first hole pattern, and wherein the dimensions of said second outer peripheral edge of each of said through-holes on said second outer side of said second hole pattern are smaller than those of said second inner peripheral edge of the respective one of said through-holes on said second inner side of said second hole pattern.

6. A metal decorative article comprising:

a first decorative member formed with a first hole pattern of through-holes, said first hole pattern having inner and outer sides, each of said through-holes extending from said outer side to said inner side, each of said through-holes in said first hole pattern having an outer peripheral edge on said outer side and an inner peripheral edge on said inner side, said outer peripheral edge of each of said through-holes having dimensions different from those of said inner peripheral edge of the respective one of said through-holes;

a second decorative member formed with a second hole pattern of through-holes, said second hole pattern having inner and outer sides respectively symmetrical to said inner and outer sides of said first hole pattern; and a frame defining a frame space having first and second ends, said first decorative member and said second decorative member being respectively received in said first and second ends of said frame space in said frame such that said inner side of said first hole pattern and said inner side of said second hole pattern face each other and are spaced apart from each other by a gap.

7. The metal decorative article of claim 6, wherein the dimensions of said outer peripheral edge of each of said through-holes on said outer side of said first hole pattern are larger than those of said inner peripheral edge of the respective one of said through-holes on said inner side of said first hole pattern.

8. The metal decorative article of claim 6, wherein the dimensions of said outer peripheral edge of each of said through-holes on said outer side of said first hole pattern are smaller than those of said inner peripheral edge of the respective one of said through-holes on said inner side of said first hole pattern.

* * * * *